US006131262A

United States Patent [19]

Freimann

[11] Patent Number: 6,131,262

[45] Date of Patent: Oct. 17, 2000

[54] BALL JOINT REMOVAL FIXTURE

[76] Inventor: Fred T. Freimann, 516 W. Industrial Ave., Boynton Beach, Fla. 33426

[21] Appl. No.: 09/080,942

[22] Filed: May 19, 1998

[51] Int. Cl.[7] ..... B25B 27/14

[52] U.S. Cl. ..... 29/281.5; 29/251

[58] Field of Search ..... 29/251, 252, 281.1, 29/281.5, 426.5; 269/40, 47, 296

[56] References Cited

U.S. PATENT DOCUMENTS

| | | | |
|---|---|---|---|
| 3,696,496 | 10/1972 | Corder . | |
| 3,745,637 | 7/1973 | Rutherford et al. . | |
| 3,791,006 | 2/1974 | Robinson . | |
| 3,883,941 | 5/1975 | Coil . | |
| 3,887,989 | 6/1975 | Maynard . | |
| 4,257,163 | 3/1981 | Bauer . | |
| 4,977,660 | 12/1990 | Maynard | 29/251 |
| 5,404,631 | 4/1995 | Boyd et al. . | |
| 5,722,147 | 3/1998 | Brazle | 29/281.1 |
| 5,806,162 | 9/1998 | Pizzino | 29/251 |
| 5,836,078 | 11/1998 | Aiken et al. | 29/251 |
| 5,839,181 | 11/1998 | Chu | 29/281.5 |
| 5,857,252 | 1/1999 | Jansen | 29/251 |
| 5,870,815 | 2/1999 | Karner et al. | 29/281.1 |

*Primary Examiner*—Robert C. Watson
*Attorney, Agent, or Firm*—Gifford, Krass, Groh, Sprinkle, Anderson & Citkowski, P.C.

[57] ABSTRACT

A ball joint removal fixture for supporting an automotive suspension spindle below a press during removal of a ball joint includes an attachment member for attachment to the spindle. The attachment member has multiple attachment points for interconnection with the spindle and at least three of the attachment points occupy and define an attachment plane. The fixture also includes a pair of support members supporting the attachment member. The support members occupy and define a support plane which forms a support angle with the attachment plane. The support angle is chosen such that when the support plane is horizontal, the central axis of a bore in the spindle occupied by the ball joint is vertical.

9 Claims, 2 Drawing Sheets

22
12
16
14
16
18
10
10
24
18
12
22
30
22
30
16
30
40
30
34
20
38
36
36
20

12
14
10
18
16
16
30
30

22
22
34
20
10
34
30
30

22
22
18
12

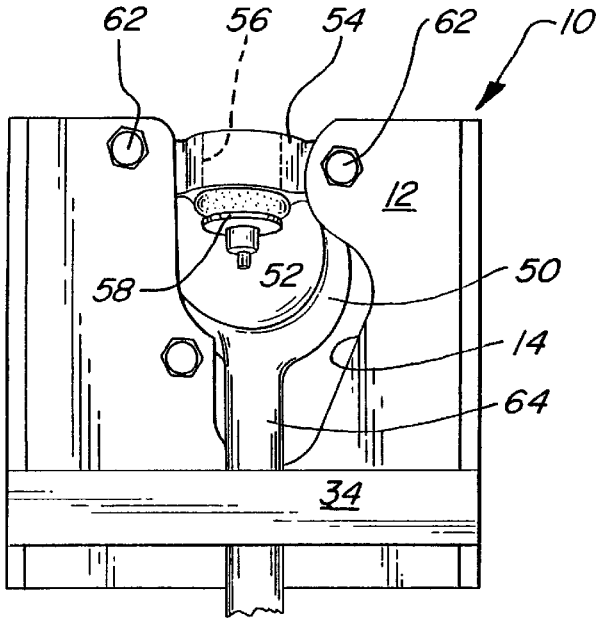
FIG-5
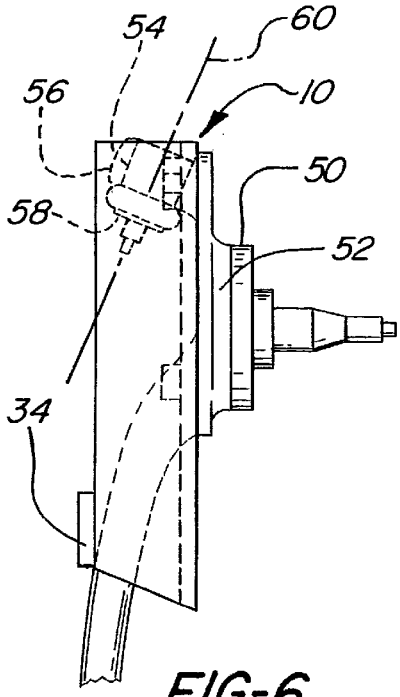
FIG-6
FIG-7
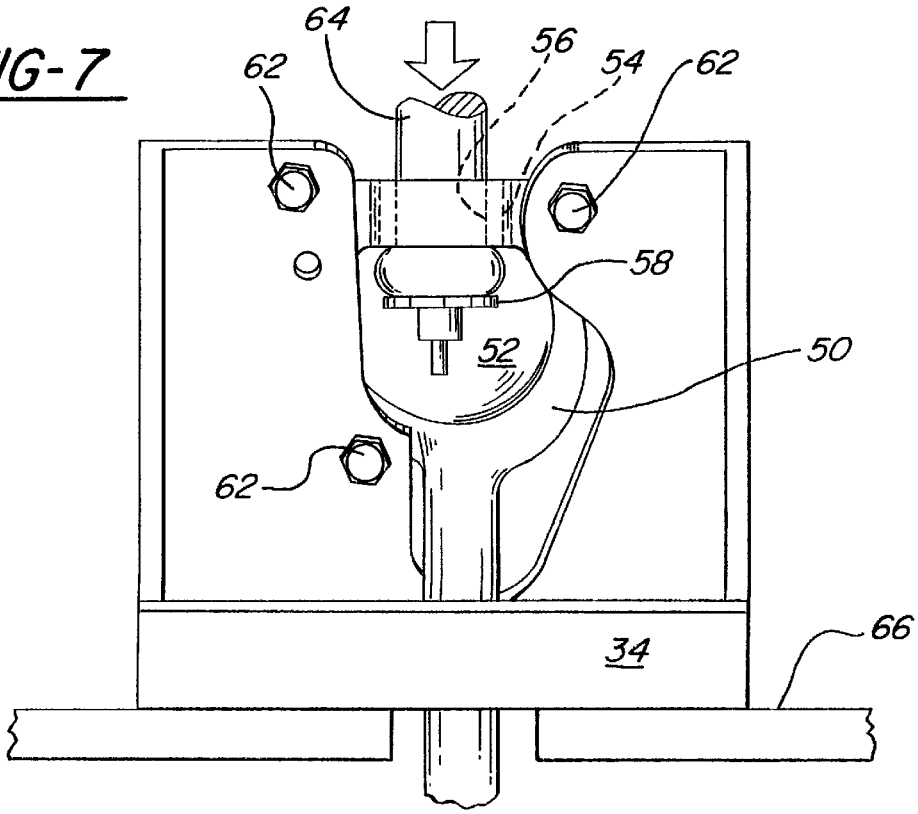

BALL JOINT REMOVAL FIXTURE

FIELD OF THE INVENTION

This invention relates generally to fixtures for supporting automotive components and more specifically to a fixture for supporting an automotive suspension spindle for ball joint removal using a press.

BACKGROUND OF THE INVENTION

Modem automobiles are highly complex machines with many moving parts, some of which eventually wear out and require replacement. Some of the parts requiring replacement are attached to the vehicle with removable fasteners and therefore the parts can be removed by simply removing the removable fasteners. Other parts, especially suspension components, are attached to the vehicle or to other parts by a press fit. A press fit typically occurs where a part with an attachment portion of a given size is forced into an opening that is somewhat smaller in size than the attachment portion of the part. For example, a ball joint, which is a type of suspension bearing, has a cylindrical metal body which is pressed into a cylindrical bore in a suspension arm or spindle. The bore in the arm or spindle is somewhat smaller than the diameter of the cylindrical body of the ball joint, and therefore forcing the ball joint into the bore requires a great deal of force. The resulting assembly is simple but very strong.

A problem arises when an automotive mechanic needs to remove a part from an automobile which has been press fit into place. To disassemble press fit parts, the assembly procedure is reversed. One part is forced out of the other. Even under ideal conditions, disassembly of a press fit part requires a great deal of force. The problem is exacerbated where the press fit parts become corroded or dirt and debris become embedded around and between the parts. When an automobile is exposed to harsh conditions, corrosion can practically lock a press fit ball joint to a suspension spindle or arm.

Another problem with press fit parts is that many of these parts are complex in shape and are not readily adapted to be disassembled using a press or puller. To remove one press fit part from another the mechanic may use a hydraulic press or a puller of some type which exerts force on one press fit part relative to the other thereby forcing the two parts apart. Presses come in a variety of styles. One common style consists of a horizontal support surface with support members extending upward therefrom. The support members support some type of pressing member which can be moved vertically downward toward the support surface. The pressing member is typically moved by a hydraulic cylinder or other means capable of exerting a great deal of force. The pressing member can be used to exert force on items supported on the horizontal support surface. For example, if two parts which are pressed together are placed on the horizontal support surface, the pressing member can be used to exert force on one of the two parts. These types of presses typically are mounted on large stands or on the floor and are not portable. Another type of press resembles a heavy duty C-clamp. In this type of press, a pressing member is adjustably attached to a support member so that an item may be supported between the support member and the pressing member. Force can then be exerted by the pressing member on the supported item.

With any type of press, it is necessary that the parts which are to be pressed apart are shaped such that they can be supported in the press. Some parts do not meet this requirement as they are complex in shape, lacking a flat surface. This is particularly the case with ball joints which are press fit into suspension spindles. Suspension spindles can be complex in shape and lack flat surfaces for support in a press. A mechanic needing to remove a ball joint from a spindle typically must resort to clamping the spindle as best he can in a large, heavy duty vise and use a large sledge hammer to pound the ball joint out of the bore. This is time consuming, difficult, and potentially dangerous. Therefore, there is a need for a fixture for supporting a spindle so that the spindle may be placed in a press and the press used to press a ball joint out of the spindle.

There have been several attempts to provide tools to simplify the removal and installation of press fit parts. For example, the following patents disclose various exractors and pushers: U.S. Pat. No. 3,696,496 to Corder, U.S. Pat. No. 3,887,989 to Maynard and U.S. Pat. No. 5,404,631 to Boyd et al. The Corder invention includes a frame plate which is positioned on one side of a member containing a press fit part. A frame portion extends on the other side of the member and a drive means is supported by the frame portion and is used to exert force against the press fit part. The Corder invention is generally representative of self-contained pushers and pullers often used to assemble and disassemble press fit parts. These devices suffer from the shortcoming that the amount of force they can produce is limited by the drive means. Typically the drive means is some kind of threaded screw and therefore the amount of force is limited by the strength of the threads on the screw. The Corder invention, and other pushers and pullers similar to it, are not adapted to position a part or member below a press and therefore cannot benefit from the much greater force of which the press is capable of exerting. Conventional pushers and pullers also tend to be complex and potentially costly. Many serious automotive mechanics already own a heavy duty hydraulic press and therefore there is a need for a fixture which can support a spindle in the press thereby taking advantage of the ability of the press to exert a great deal of force.

Another approach is illustrated in U.S. Pat. No. 3,745,637 to Rutherford et al. The Rutherford invention is an adapter plate which allows the use of a conventional puller to remove ball joints from a spindle. Traditional pullers consist of two or more gripping arms and a pressing member, all of which extend from a main body. The gripping arms are used to grip an object having a press fit part therein. The pressing member is then brought to bear on the press fit part so that the jaws pull one direction on the object while the pressing member presses in the opposite direction on the press fit part. A disadvantage to traditional pullers is that many objects are not shaped to allow the gripping members to grip the object. The Rutherford invention helps overcome this limitation by providing an adapter plate which provides locations for gripping members to connect to an automotive part. However, the Rutherford invention is still limited in that it is designed to be used with a puller rather than with a press. Even the best of pullers are not capable of exerting the amount of force which even a small hydraulic press can create.

SUMMARY OF THE INVENTION

There is disclosed herein a ball joint removal fixture for supporting an automotive suspension spindle below a press during removal of a ball joint. The spindle is of the type having a bore occupied by a press fit ball joint. The fixture has an attachment member for attachment to the spindle. The attachment member has multiple attachment points for interconnection with the spindle, and at least three of these attachment points occupy and define an attachment plane. The fixture also has a first and a second support member which support the attachment member. The support members occupy and define a support plane, which forms a support angle with the attachment plane. The support angle is chosen such that when the support plane is horizontal, the central axis of the ball joint bore in a spindle attached to the fixture is vertical. Also disclosed is a method for removing a ball joint from a spindle using the fixture.

BRIEF DESCRIPTION OF THE DRAWINGS

FIG. 5 is a rear elevational view of a ball joint removal fixture according to the present invention with an automotive suspension spindle attached thereto;

FIG. 6 is a side elevational view of the fixture and spindle of FIG. 5; and FIG. 7 is a rear elevational view of the fixture and spindle of FIG. 5 supported on a horizontal surface of a press.

DETAILED DESCRIPTION OF THE PREFERRED EMBODIMENTS

Figures 1, 2, 3, 4:
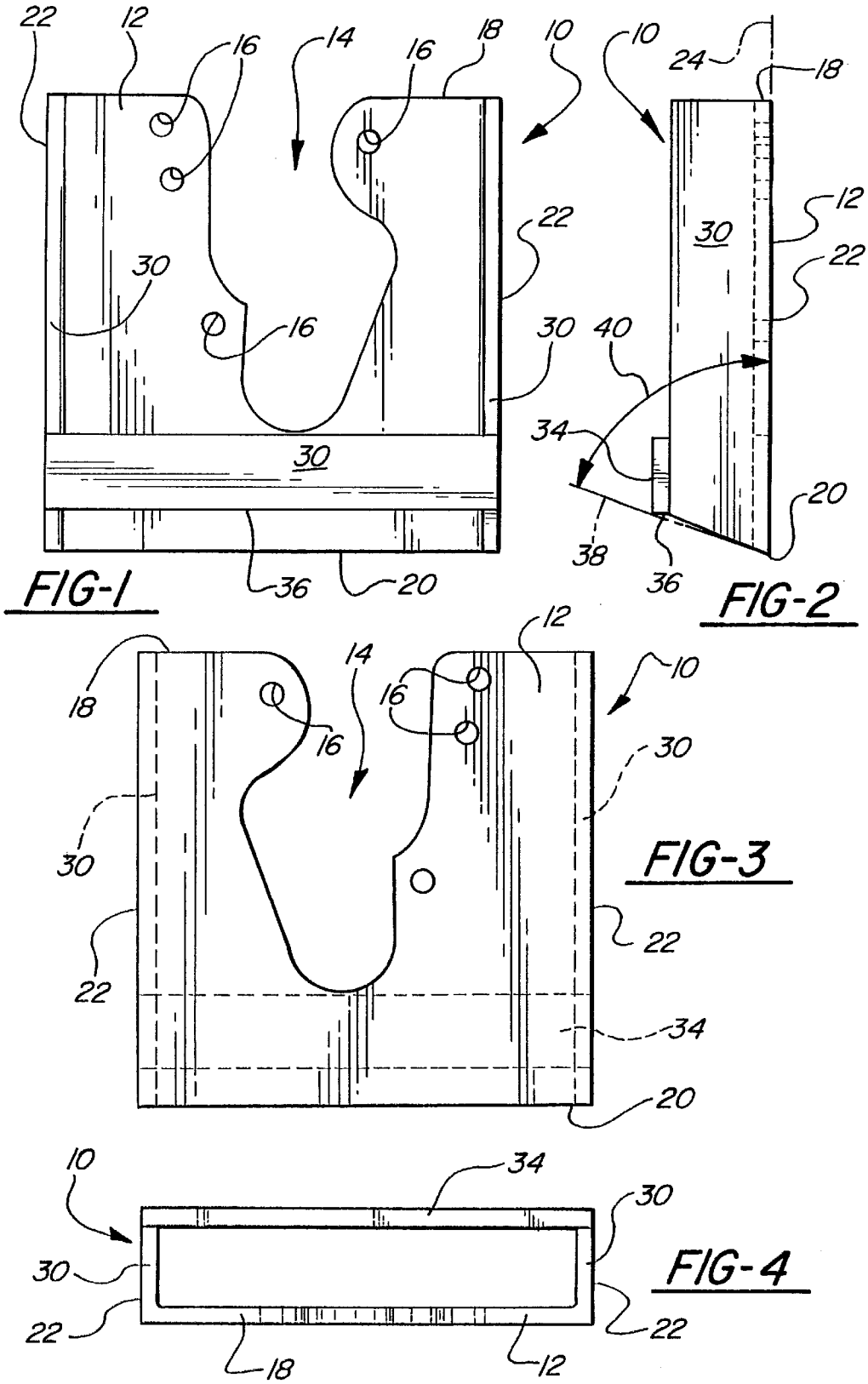
FIG. 1 is a rear elevational view of a ball joint removal fixture according to the present invention.
FIG. 2 is a side elevational view of the fixture of FIG. 1.
FIG. 3 is a front elevational view of a fixture of FIG. 1.
FIG. 4 is a top plan view of the fixture of FIG. 1.

Referring to FIGS. 1–4, a ball joint removal fixture according to the present invention is generally illustrated at 10. The fixture 10 is made up of several pieces which are welded together to create a rigid structure. An attachment member 12 is in the form of a rectangular steel plate with a large irregular cutout 14. The cutout 14 is shaped so as to give clearance for a suspension spindle as will be described later. Attachment member 12 also includes a plurality of attachment points 16 which in the preferred embodiment are round holes defined through the steel plate. The attachment member 12 has a top edge 18, a bottom edge 20, and a pair of side edges 22 interconnecting the top and bottom edges. The irregular cutout 14 extends from the top edge 18 of the attachment member 12 downwardly for approximately two-thirds of the distance to the bottom edge 20 of the attachment member 12. The attachment points 16 are arranged around the cutout 14. Preferably the attachment member 12 is a plate and the plate occupies and defines a plane which is referred to herein as an attachment plane 24. The attachment points 16 also all reside in this plane. Alternatively, if the attachment member 12 is not a plate and not planar, at least three of the attachment points 16 would occupy and define the attachment plane 24.

Extending from each of the side edges 22 of the attachment member 12 is a side plate 30. The side plates 30 are preferably shaped as elongated rectangular plates having one of their long edges joined to a side edge 22 of the attachment member and the other long edge positioned away from the attachment member 12. Each of the side plates 30 extend at approximately right angles to the attachment member 12. The side plates 30 may be formed as an integral part with the attachment member 12 or alternatively may be separate plates which are welded or otherwise attached to the attachment member 12. Preferably, the attachment member 12 and the side plates 30 are formed from one piece of C-channel steel. The side plates 30 act to significantly increase the rigidity of the overall fixture 10.

A first support member 34 takes the form of a rectangular steel bar and is welded between the long edges of the side plates 30 so that it is parallel to and spaced from the attachment member 12. The first support member 34 has a lower edge 36 for contacting a support surface, especially under a press. The lower edge 36 of the first support member 34 and the lower edge 20 of the attachment member 12 cooperate to support the attachment member 12 below a press. As can best be seen in FIG. 2, the lower edge 36 of the first support member 34 and the lower edge 20 of the attachment member 12 define a support plane 38 which intersects the attachment plane 24 at an angle referred to herein as a support angle 40. Support angle 40 may be varied depending on the application of the fixture 10. Preferably, the angle 40 is an acute angle so that when the lower edge 36 of the first support member 34 and the lower edge 20 of the attachment member 12 are supported on a horizontal support surface, the attachment plane 24 is not vertical but rather is positioned at an angle to the vertical.

While the support plane 38 is illustrated as defined by the lower edge 36 of the first support member 34 and the lower edge 20 of the attachment member 12, this is only one embodiment of how the attachment member 12 is supported. In more general terms, the fixture 10 will have both a first support member 34 and a second support member which cooperate to support the attachment member 12. In the illustrated embodiment, the second support member is essentially formed integral to the attachment member 12 rather than as a separate piece and therefore the lower edge 20 of the attachment member 12 takes the place of a lower edge of a second attachment member. However, as will be clear to one of skill in the art, the fixture 10 may instead be constructed with a first and second support member in a variety of configurations so as to support an attachment member 12 which may or may not be a flat plate of steel.

Turning now to FIGS. 5–7, the fixture 10 is illustrated with a spindle 50 attached. The spindle 50 illustrated is of the type used on some Mercedes Benz automobiles and is illustrated upside down as compared to the position it would occupy when installed in the automobile. Spindle 50 has a central body 52 with a lower ball joint mount 54 extending therefrom. The ball joint mount 54 has a bore 56 defined therethrough into which is press fit a ball joint 58. The bore 56 and the ball joint 58 may both be cylindrical or may both be tapered depending on the design and application of the spindle 50. As shown in FIG. 6, the central axis 60 of the bore 56 is positioned at an angle to the remainder of the spindle 50. The positioning of the ball joint bore 56 and the angle of the central axis 60 depend upon the design and application of the spindle 50. The spindle is complex in shape, as shown, and therefore difficult to position in a press for ball joint removal. As shown, the spindle 50 is attached to the fixture 10 using several bolts 62. These bolts 62 pass through the attachment points 16 in the fixture 10 and engage bolt holes in the spindle 50. The bolt holes in the spindle 50 exist for other reasons such as mounting brake componentry to the spindle 50. By mounting the spindle 50 to the fixture 10 using several bolts 62, the spindle 50 is solidly attached to the fixture 10. As shown, the spindle also includes an upper arm 64 extending away from the main body 52 and away from the lower ball joint mount 54. The cutout 14 in the attachment member 12 is shaped so as to give clearance for both the lower ball joint mount 54 and the upper arm 64. The spacing between the first support member 34 and the attachment member is also designed to give clearance for the upper arm 64 of the spindle 50 when it is bolted to the attachment member 12.

As shown in FIGS. 5 and 6, with the spindle 50 bolted to the fixture 10 and with the attachment member 12 being positioned vertically, the central axis 60 of the ball joint bore 56 is not vertical. Hydraulic presses typically have pressing members 64 which move vertically as shown in FIG. 7. In FIG. 7, the fixture 10 and the attached spindle 50 are shown supported on a horizontal surface 66 of a press. In this position, the central axis 60 of the ball joint bore 56 is vertical and therefore the pressing member 64 can easily and conveniently press the ball joint 58 out of the bore 56.

In use, the spindle 50 is first removed from an automobile and is then mounted into the fixture 10 using a plurality of bolts 62. The fixture 10 and attached spindle 50 are than placed within the press on the horizontal surface 66 and the pressing member 64 of the press is then used to press the ball joint 58 out of the ball joint bore 56. A new ball joint is then installed into the bore 56 using other tools and the spindle 50 is reinstalled onto the automobile. Prior to the present invention, it was necessary to place the spindle 50 in a vise and to use a large sledgehammer to pound the ball joint 58 out of the bore 56. This was abusive to the spindle 50, required significant time and effort, and was potentially dangerous. In the present invention, a ball joint 58 can be removed from a ball joint bore 56 very quickly and easily. As will be clear to one of skill in the art, spindles 50 from various automobiles will differ and therefore the precise configuration of the fixture 10 depends on the application. However, the unifying characteristic is that fixture 10 is designed to support the spindle 50 such that the central axis 60 of the ball joint bore 56 is vertical, allowing the use of a hydraulic press to press the ball joint 58 out of the bore 56. Even for the same automobile, the spindles 50 from opposite sides of the automobile differ in shape, typically being mirror images of one another. Therefore two fixtures 10 are required to remove ball joints from one automobile. Within an automaker's line of products, several models of vehicle may use the same spindle configuration and therefore the same fixture 10 may be used for a variety of vehicle models. Alternatively, several fixtures may be required. Also alternatively, fixture 10 can be made adjustable such that the first support member 34 can be repositioned so as to change the support angle 40. The attachment points 16 on the attachment member 12 can be made as elongated slots or a larger number of attachment points may be provided so that the fixture 10 accommodates a wider range of spindles 50.

In view of the teaching presented herein, other modifications and variations of the present inventions will be readily apparent to those of skill in the art. The foregoing drawings, discussion, and description are illustrative of some embodiments of the present invention, but are not meant to be limitations on the practice thereof. It is the following claims, including all equivalents, which define the scope of the invention.

I claim:

1. A ball joint removal fixture for supporting an automotive suspension spindle below a press during removal of a ball joint, the ball joint occupying a bore when installed in the spindle, the bore having a central axis, said fixture comprising:

an attachment member for attachment to the spindle, said member having a plurality of attachment points for interconnection with the spindle, at least three of said attachment points occupying and defining an attachment plane;

a first and a second support member supporting said attachment member, said support members occupying and defining a support plane, said support plane forming a support angle with said attachment plane, said support angle being chosen so that when said support plane is horizontal, the central axis of the bore is vertical; and a pair of side plates interconnecting said attachment member and said support members.

2. The ball joint removal fixture of claim 1, herein said attachment member is a plate with a cutout defined therein, said cutout configured to allow clearance for portions of the spindle.

3. A ball joint removal fixture for supporting an automotive suspension spindle below a press during removal of a ball joint, the ball joint occupying a bore when installed in the spindle, the bore having a central axis, said fixture comprising:

an attachment member for attachment to the spindle, said member having a plurality of attachment points for interconnection with the spindle, at least three of said attachment points occupying and defining an attachment plane, said attachment member having a lower edge;

a first and a second support member supporting said attachment member, said lower edge of said attachment member forming said first support member, said support members occupying and defining a support plane, said support plane forming a support angle with said attachment plane, said support angle being chosen so that when said support plane is horizontal the central axis of the bore is vertical.

4. The ball joint removal fixture of claim 1, wherein said support angle is in the range of 45 to 90 degrees.

5. A ball joint removal fixture for supporting an automotive suspension spindle below a press during removal of a ball joint, the ball joint occupying a bore when installed in the spindle, the bore having a central axis, said fixture comprising:

an attachment member for attachment to the spindle, said member having a plurality of attachment points for interconnection with the spindle, at least three of said attachment points occupying and defining an attachment plane, said member having a lower edge;

a support member connected to said attachment member, said support member having a lower edge, said lower edge of said support member and said lower edge of said attachment member occupying and defining a support plane, said support plane forming a support angle with said attachment plane, said support angle being chosen so that when said support plane is horizontal, the central axis of the bore is vertical.

6. The ball joint removal fixture according to claim 5, further comprising a pair of side plates extending from said attachment member and interconnecting said attachment member and said support member.

7. The ball joint removal fixture of claim 3, wherein said attachment member is a plate with a cutout defined therein, said cutout configured to allow clearance for portions of the spindle.

8. The ball joint removal fixture of claim 3, wherein said support angle is in the range of 45 to 90 degrees.

9. The ball joint removal fixture of claim 5, wherein said support angle is in the range of 45 to 90 degrees.

* * * * *